US008464401B2

(12) United States Patent
Littell

(10) Patent No.: US 8,464,401 B2
(45) Date of Patent: Jun. 18, 2013

(54) SUPPORT DEVICE

(76) Inventor: Dorothy Ann Littell, Denver, CO (US)

( * ) Notice: Subject to any disclaimer, the term of this patent is extended or adjusted under 35 U.S.C. 154(b) by 555 days.

(21) Appl. No.: 12/817,112

(22) Filed: Jun. 16, 2010

(65) Prior Publication Data

US 2010/0242157 A1 Sep. 30, 2010

Related U.S. Application Data

(63) Continuation-in-part of application No. 11/460,971, filed on Jul. 29, 2006, now abandoned.

(51) Int. Cl.
*A41C 3/12* (2006.01)

(52) U.S. Cl.
USPC ..... 24/3.1; 24/695; 450/41; 450/52

(58) Field of Classification Search
USPC ..... 24/3.1, 3.12, 695; 450/41, 52
See application file for complete search history.

(56) References Cited

U.S. PATENT DOCUMENTS

| | | | | | |
|---|---|---|---|---|---|
| 1,297,742 | A | | 3/1919 | Shorrock | |
| 2,938,215 | A | | 5/1960 | Schwartz | |
| 3,114,374 | A | * | 12/1963 | Chalfin et al. | 450/41 |
| 3,129,435 | A | | 4/1964 | Spence | |
| 3,209,756 | A | | 10/1965 | Rowell | |
| 3,599,643 | A | | 8/1971 | Schwartz | |
| 3,605,753 | A | | 9/1971 | Schwartz | |
| 3,702,614 | A | * | 11/1972 | Miller | 450/52 |
| 3,799,175 | A | | 3/1974 | Rowell | |
| 4,133,316 | A | | 1/1979 | Schwartz | |
| 4,275,740 | A | * | 6/1981 | Weston | 450/45 |
| 4,306,565 | A | | 12/1981 | Rowell | |
| 5,387,150 | A | * | 2/1995 | Terrell | 450/41 |
| 5,730,641 | A | | 3/1998 | Brown | |
| 5,749,767 | A | | 5/1998 | Arceo | |
| 5,830,040 | A | | 11/1998 | Morgan et al. | |
| 6,066,027 | A | | 5/2000 | Fildan | |
| 6,102,774 | A | | 8/2000 | Avellanet | |
| 6,152,802 | A | * | 11/2000 | Horta et al. | 450/52 |
| 6,375,538 | B1 | | 4/2002 | Allen et al. | |
| 6,438,808 | B1 | * | 8/2002 | Kung | 24/3.12 |
| 6,468,130 | B1 | | 10/2002 | Thakur et al. | |
| 6,780,080 | B2 | | 8/2004 | Horta et al. | |
| 6,857,933 | B2 | * | 2/2005 | Horta et al. | 450/41 |
| 6,896,580 | B2 | | 5/2005 | Falla et al. | |
| 7,666,060 | B2 | * | 2/2010 | Cheung | 450/41 |
| 2005/0124261 | A1 | | 6/2005 | Martini | |
| 2005/0197043 | A1 | * | 9/2005 | Horta et al. | 450/41 |
| 2009/0156095 | A1 | * | 6/2009 | Cheung | 450/52 |
| 2009/0156096 | A1 | * | 6/2009 | Horta et al. | 450/52 |

* cited by examiner

*Primary Examiner* — Robert J Sandy
(74) *Attorney, Agent, or Firm* — Roger A. Jackson

(57) ABSTRACT

A support device and method of installation is disclosed to help prevent the protrusion of a relatively rigid support structure end portion from garments such as bras, corsets, swimsuits, and other articles of clothing. The support device includes a base, a surrounding sidewall extending from the base with the surrounding sidewall terminating in an opening. The base and surrounding sidewall define an interior being operational to loosely receive the end portion of the support structure associated with the garment such as a bra underwire. The support device also includes a flange extending from the surrounding sidewall which is positioned to be oppositely disposed of the interior, wherein the flange is adapted to attach to the garment.

15 Claims, 14 Drawing Sheets

SUPPORT DEVICE

RELATED APPLICATION

This continuation in part (CIP) patent application claims priority from U.S. patent application Ser. No. 11/460,971 filed on Jul. 29, 2006 now abandoned by Dorothy Ann Littell of Denver, Colo., US.

TECHNICAL FIELD

The present invention is broadly related to articles of clothing in the form of foundation garments and their associated support structures. More particularly, the present invention is a support device that is associated with foundation garment support structure in the form of a bra "underwire" and its retention within a bra fabric underwire casing. The present invention specifically concerns an end portion of the bra underwire that has the potential to undesirably protrude out of the bra fabric underwire casing disposed within the bra fabric. Wherein, the bra underwire end portion protrusion is due to the repetitive relative movement between the relatively stiff underwire to the soft and flexible bra fabric and bra fabric underwire casing from movement of the bra user.

BACKGROUND OF THE INVENTION

The use of relatively rigid support structures to provide shape and support for foundation garments such as bras, corsets, swimsuits, girdles, and the like is fairly old in the art. In the case of a bra this relatively rigid support structure is typically constructed of a flat spring type steel strip that is configured in somewhat of a "U" or semi circular type shape which is typically called the bra underwire. The underwire forms a semicircular base for the lower half of each breast cup, wherein the underwire is positioned approximately at the interface between the user's torso and each their breasts. The underwire is disposed within the bra fabric casing to create omnidirectional support rigidity for each breast cup of the bra, wherein the bra is necessarily made from a soft and sometimes shear (see through) fabric for bra user comfort adjacent to their skin and for appearance reasons. This underwire end portion protrusion from the bra fabric underwire casing can be caused from a number of factors that include bra user upper torso and arm movement, forces to the bra that are external to the bra user, and bra fabric deterioration from washing, drying, and aging. When the bra underwire end portion does protrude or "poke through" the bra fabric underwire casing, this results in damage to the bra fabric underwire casing and possible injury to the bra user from the protruding underwire end portion chaffing or piercing the bra user's skin adjacent to the bra fabric underwire casing/underwire end portion interface. The present invention of a support device helps to retain the underwire end portion in the bra fabric casing thus assisting in the prevention of the underwire end portion poking through the bra fabric casing.

Physical activities such as running, tennis, bicycling, wrestling, swimming, and the like by the user of the bra can all contribute to the underwire end portion poking through the bra fabric underwire casing. In addition, because most bras have two separate underwires that are non symmetrically shaped and fairly rigid i.e. the "U" shape, wherein when the underwire experiences a force from the user's movement, it typically causes the underwire to experience both a torsional (twisting) loading (movement) and a combined lateral (lengthwise) movement, so that the underwire end portion will exert both protruding force against the bra underwire casing fabric that is transverse to the underwire lengthwise axis and a force parallel to the underwire lengthwise axis, intensifying (due to the combined forces) the potential for poke through damage from the underwire end portion through the bra underwire casing. This is as opposed to a symmetric garment stiffener, i.e. straight not being "U" shaped, wherein a force at one end will typically result in a single force at the other end that is parallel to the stiffener lengthwise axis. The problem is that once the underwire end portion protrudes through the bra underwire casing, the entire bra assembly is essentially useless, and the bra underwire casing is not easily repaired nor worth repairing as most repairs will cause a weak spot from excess stitching.

Further, the protruding underwire end portion can cause chaffing, blistering, and even piercing of user's skin in the chest or torso area causing extreme discomfort and risk of infection and injury for the user of the bra. Additionally, the user's clothing adjacent to the bra can be damaged from the underwire end portion piercing the bra underwire casing. Further, even if the bra underwire casing does not get ripped open from the underwire end portion poking through, the bra underwire casing fabric adjacent to the underwire end portion can apply a localized area pressure on the bra transmitting against the user's torso and/or breast area housing causing user discomfort by chaffing, blistering, and the like. Furthermore, even when the bra is of the correct size (breast cup size wise), variations in the user's body type i.e. anatomical differences (such as tall or short, heavy set or thin builds) can result in a bra misfitting discomfort to the user, and typically adds to the user torso/arm movement leading to the aforementioned relative movement of the underwire relative to the bra underwire casing thus increasing the probability of the underwire end portion protruding through the bra underwire casing rendering the bra unusable and risking user injury as previously discussed.

The problem of the bra underwire end portion protruding from the underwire casing of the bra fabric is inherent in the structural design of having a desirably soft and relatively flexible bra material (as against the user's chest and torso) being structurally adjacent to a desirably rigid and stiff material for the bra underwire (to give a desired shape and contour to the user's breasts). This interface between the hard and soft materials of necessity causes strength of materials issues as well as separation and displacement issues. Thus, the aforementioned bra fabric and underwire end portion protrusion problem is well recognized in the prior art. The prior art primarily focuses upon adding a soft tip to the underwire end portion or providing a hard restraint for the underwire end portion within the bra fabric casing to help prevent protrusion of the underwire end portion from the bra underwire casing and attempting to lessen the previously described effects of the highly localized pressure area that the underwire end portion can apply through the bra fabric underwire casing to the user's torso and/or breast.

One approach in recognition of the underwire end portion potentially protruding through the bra fabric casing it to have the underwire free ends or tips include a soft type of polymeric tip. As an example in U.S. Pat. No. 6,468,130 B1 to Thakur et al., disclosed is a bra underwire having polymeric tips that are slidably engaged (longitudinally) to the underwire to allow for lengthening or shortening of the underwire during use. Thakur et al., helps prevent the underwire from protruding through the bra underwire casing material when the user is twisting or bending while wearing the bra. However, a problem with Thakur et al., is that by affixing the polymeric tip to the bra underwire casing fabric, additional compressive force from the bra movement will cause the underwire shortening to "bottom out", leading to a high probability that the tip will still protrude through the underwire casing fabric and causing the aforementioned user problems. Another approach in addressing a portion of the problems associated with underwires is seen in U.S. Pat. No. 6,102,774 to Avellanet that discloses a bra support element secured to the bra fabric that is designed to prevent twisting of the underwire that is in the form of a cable to retain its "U" shape, but not necessarily to prevent protrusion of the cable end from the bra. Similar to Thakur et al., in U.S. Pat. No. 3,599,643 to Schwartz, disclosed is a removably engagable protective end cover for use with the underwire tip that includes a stitching hole to sew the end cover to the bra fabric. Furthermore, in Schwartz '643 the end cover has a somewhat pointed tip that increases the risk of the tip wearing through the bra fabric, in addition the stitching is put in shear stress (from the underwire longitudinal movement), thus the stitching is more likely to fail along with stressing the fabric in a small area adjacent to the stitch, such that with the single point stitch hole the fabric is also subject to failing, resulting in the underwire tip again being able to protrude through the bra casing fabric.

Further approaches include encasing the underwire in a multilayered and padded pocket as in United States Patent Application Publication No. US2005/0124261 A1 to Martini being specifically shown in FIG. 4, however, possibly adding an undesirable level of bulkiness to the bra, specifically in the underwire area. In a similar approach to Martini, in U.S. Pat. No. 6,896,580 B2 to Falla et al., disclosed is a protected underwire wherein the underwire is encased within a bladder that is within a gelatinous material to "soften" the feel of the underwire for the bra user. However, Falla et al., does not have a provision to definitively prevent the ends of the underwire protruding from the bra. Further, in a different approach to the underwire tip protrusion issue is in U.S. Pat. No. 6,780,080 B2 to Horta et al. that discloses an underwire soft tip that helps to prevent the underwire from protruding from the bra, with the soft tip itself not attached to the bra fabric. However, with Horta et al., there is still a risk of underwire protrusion from the bra sleeve at the soft tip and underwire interface, again the issue of a hard and soft material interface having potential problems with the soft tip potentially yielding and thus allowing the underwire to protrude from the bra. Likewise, in U.S. Pat. No. 4,306,565 to Rowell, disclosed is a bra underwire having soft encapsulated tips that are affixed to each underwire end, having a pin attachment between the underwire and the tip. However, in Rowell '565 the soft tip is not attached to the bra fabric sleeve, thus having the same shortcomings as Horta et al.

Similar to Horta et al., and Rowell '565, where a soft tip is included on the underwire end, is in U.S. Pat. No. 6,375,538 B1 to Allen et al., that discloses a bra underwire that has a wide soft tip designed to minimize wear on the underwire sleeve or casing fabric during use. Allen et al., has the configuration of the bra cups positioned to enhance cleavage size, however, not addressing the problem of the underwire potentially protruding through the bra fabric. Continuing in the soft underwire tip area in U.S. Pat. No. 5,830,040 to Morgan et al., disclosed is a narrow cushion tip for a bra underwire wherein the soft tip is smaller in width than the underwire width. Morgan et al., utilizes the narrow soft tip width for ease of assembly, i.e. sliding the underwire and soft tip into the bra fabric casing. Thus in Morgan et al., addressed is the assembly ease issue, as with most other designs like Allen et al., Schwartz '643, and Thakur et al. the soft tip on the underwire is wider than the underwire width, which makes it difficult to slide the underwire and wider soft tips into the fabric sleeve for assembly of the bra. However, the problem with Morgan et al., is that it will require a special underwire end for interface with the narrow soft tip, in addition to the previously described problem of the soft tip not attached to the bra fabric having the same shortcomings as Rowell '565 and Horta et al.

As with Morgan et al., U.S. Pat. No. 4,133,316 to Schwartz discloses a bra underwire with attached plastic caps for use with narrow flat underwires. Schwartz '316 also includes a locking structure of the narrow flat underwire to the plastic cap, however, as with Morgan et al., Rowell '565, and Horta et al., Schwartz '316 does not stitch the cap to the bra fabric, thus the cap only provides a rounded blunt tip that is "softer" that the underwire itself. Another approach to underwire soft tips is in U.S. Pat. No. 6,066,027 to Fildan that discloses a bra that uses an underwire with wide soft tips. Fildan has the underwire constructed of nylon, with the materials of construction for the underwire being resilient to be in conjunction with the soft to help prevent protrusion of the underwire from the bra sleeve. Fildan also places emphasis upon the circumferential length of the underwire for added support being about 270 degrees as opposed to the typical underwire circumferential length standard of about 180 degrees. Yet, another further approach to the underwire tip protrusion problem is shown in U.S. Pat. No. 5,749,767 to Arceo by dramatically increasing the area of the tip by using a "T" type shape. Here, the Arceo "T" shaped underwire tips greatly increase the area of the sleeve fabric that is exposed to bearing load from the underwire tip to help prevent protrusion of the underwire through the bra. One problem with Arceo is that the "T" shaped tip can still cause added discomfort to the user because of the significant increase in underwire tip size in addition to the problems with excessive bulkiness of the bra in the underwire tip area. Continuing, in U.S. Pat. No. 5,730,641 to Brown disclosed is a bra underwire tip similar to Arceo except for having a kidney shaped end as opposed to a "T" shaped end.

Other prior art approaches toward retaining bra underwire tips in the bra fabric casing are in U.S. Pat. No. 3,799,175 to Rowell which discloses a bra underwire with a tip cap that is pierceable by a sewing needle in order to attach the cap to the bra fabric sleeve, with a retained slidable engagement between the underwire tip and the cap, being similar to both Thakur et al., (for the slidable engagement) and Schwartz '643 (for the stitching through feature of the underwire tip). However, in Rowell '175 the cap is only attached to the bra fabric sleeve by a single stitching aperture and the tip is somewhat pointed which increases the likelihood of additional bearing wear against the bra fabric sleeve and discomfort to the user form the somewhat pointed tip having a smaller bearing area against the bra fabric sleeve that transmits to the user's breast and/or torso. However, in Rowell '175 the slidable engagement of the tip to the underwire does accommodate some degree of bra fabric movement as previously mentioned. Alternatively, for a more permanently affixed (non moving) attachment of the soft tip to the underwire, in U.S. Pat. No. 3,129,435 to Spence disclosed is an underwire tip having a unique attachment to the underwire although the tip is not attached to the sleeve, as Spence fully recognizes the problem of attaching or trying to bond a hard and a soft material together and attempts to correct this problem by molding the soft tip on to the underwire end. Furthermore, another approach to the underwire protruding through the bra fabric casing is in U.S. Pat. No. 3,605,753 to Schwartz that discloses a bra supporting underwire with soft tip ends wherein the underwire is completely encased in a polymeric material that varies its cross section (length wise) to optimize the user's comfort, i.e. having a thicker cross section at the lengthwise center of the underwire. However, in Schwartz '753 as with Arceo and Brown, the extra bulk in the area of the underwire of the bra may be undesirable to the user.

Similar to Schwartz '753 in looking at U.S. Pat. No. 3,209,756 to Rowell that discloses a bra underwire that is also completely encased like Schwartz '753 with varying cross section lengthwise that is different that the Schwartz "753 cross section change lengthwise, with Rowell '756 having the same drawbacks as previously described for Schwartz '753, Arceo, and Brown, wherein again the extra bulk in the area of the underwire of the bra may be undesirable to the user. A further approach is in having a wide area flange of a soft material at the underwire tip such as in U.S. Pat. No. 1,297,742 to Shorrock that discloses a corset stay that is of a soft material having a semicircular flange extension margin that can be stitched through. However, in Shorrock the stitching is still put in shear stress like Schwartz '643 and Rowell '175 with the previously described drawbacks of weakening the attachment of the soft underwire or stay tip to the bra or corset fabric. In addition, similar to Schwartz '643 and Rowell '175 in looking at U.S. Pat. No. 2,938,215 to Schwartz disclosed is a flexible tip with a thinned section that can be stitched through with the purpose of holding the bra underwire tip in place. However, Schwartz '215 will have the same functional shortcomings as previously mentioned in Shorrock.

What is needed is a support device that can secure the bra underwire end portion to the bra fabric casing sleeve by having a "soft" restraint that can accommodate user torso and arm movement without adding much bulk to the bra fabric casing sleeve adjacent to the underwire end portion such that the user is practically unaware of the support device being installed in the bra. The key to the soft restraint is in allowing some degree of movement of the underwire end portion within the bra fabric casing sleeve to cushion the restraint so as to reduce the bearing load that the underwire end portion would normally have against the bra fabric casing sleeve. Even though Rowell '175 has a slidable engagement of the tip to the underwire, allowing some amount of movement, once the slidable engagement bottoms out, the tip will put the stitching and the adjacent fabric in shear stress i.e. the weakest strength of material for the stitching and adjacent fabric potentially leading to failure of the stitching and then the undesirable protrusion of the tip through the bra fabric with the aforementioned problems. Thus, a more desirable soft restraint would allow for omnidirectional movement between the underwire end portion and the support device in the form of a couple that could facilitate the support device attachment to the bra fabric being movable such that the attachment stitching when restraining the underwire end portion could be substantially put into tension (as opposed to shear) along with the adjoining bra fabric to increase the strength of the support device attachment, thus helping to further preclude the undesirable protrusion of the underwire end portion through the bra fabric with the attendant previously discussed problems.

SUMMARY OF INVENTION

Broadly, the present invention includes a base, a surrounding sidewall extending from the base terminating in an opening, wherein the base and sidewall define an interior which is sized and configured to loosely receive a portion of the support structure associated with an article of clothing such as a bra underwire. The present invention also includes a flange extending from the sidewall which is positioned to be oppositely disposed of the interior, wherein the flange is adapted to attach to the article of clothing. Operationally, the present invention helps to prevent the protrusion of a relatively rigid support structure end portion from the article of clothing that is in the form of garments such as bras, corsets, swimsuits, and the like.

REFERENCE NUMBERS IN DRAWINGS

Figure 1:
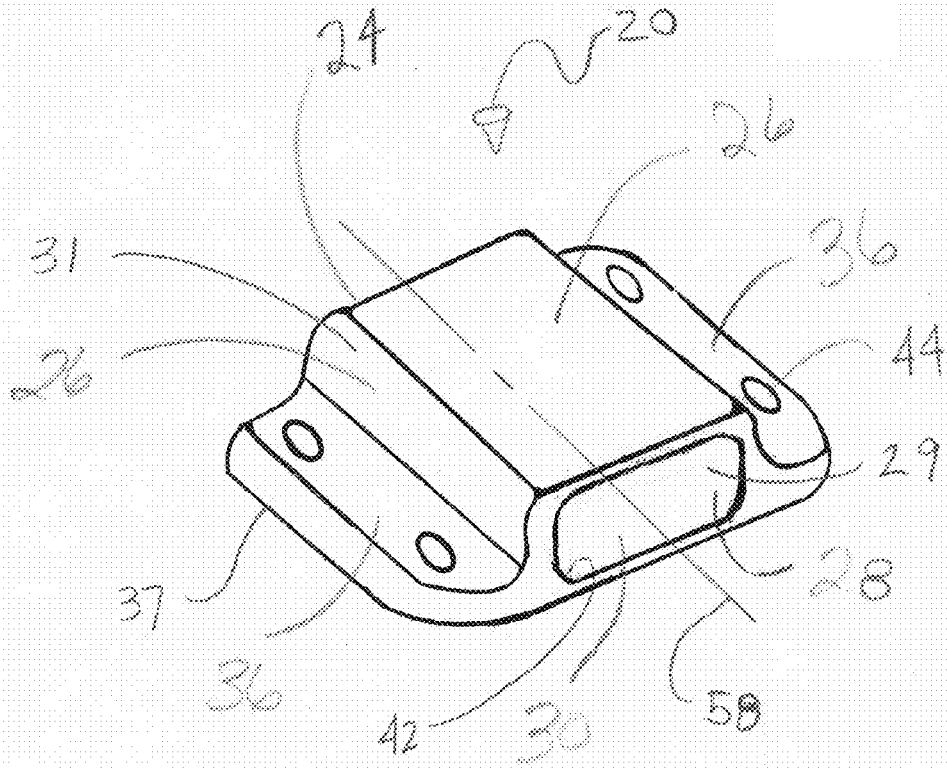
FIG. 1 shows a perspective view of a support device with a base, a sidewall extending from the base, and with the sidewall terminating in an opening, wherein the base and sidewall define an interior, also shown is a flange that is oppositely disposed of the interior, wherein the flange has a plurality of apertures.

20. Support device
22. Article of clothing
23. Bra assembly
24. Base
25. Surface of the base 24
26. Surrounding sidewall
27. Surface of surrounding sidewall 26
28. Opening
29. Area of opening 28
30. Interior
31. Exterior of surrounding sidewall 26
32. Support structure
33. Rectangular cross sectional area of support structure 32
34. Portion of the support structure 32 associated with the article of clothing 20
35. Lengthwise axis of support structure 32
36. Flange
37. Planar surface of flange 36
38. Fabric
39. Bra underwire
40. Bra 23 underwire 39 end portion
41. Movement or force of bra underwire 39 end portion 40 in a limited omnidirectional manner
42. Substantially continuous curved surfaces 25 and 27 of the interior 30
43. Bra underwire 39 end portion 40 or 68 protrusion or poking through with fabric sleeve end 73 failure
44. Aperture(s)
45. Bra 23 fabric 38 underwire 39 casing
46. Attaching Element
47. Interface between bra 23 underwire 39 end portion 40 or 68 and casing 45 or 71
48. Attachment stitching
49. Lengthwise axis of underwire 39
50. Force in tension at attachment element 46
51. Force in tension in fabric 38
52. Force in shear at attachment element 46
53. Force in shear in fabric 38
54. Loosely receiving of the support structure 32 or bra wire 39 by the interior 30
55. Fasteners
56. Adhesive
57. Hook and loop fastener
58. Longitudinal axis of support device 20
60. Fabric 38 deflection
62. User
63. Movement of user
64. Selected position of the support device 20 adjacent to the article of clothing 22
65. Contact of underwire end portion 68 with user 62
66. Prior art bra
67. Prior art bra 66 fabric
68. Prior art bra 66 underwire end portion
70. Prior art bra 66 tip protector
71. Prior art bra 66 fabric 67 casing
72. Prior art bra 66 tip protector 70 stitching
73. Prior art bra 66 fabric 67 casing 71 sleeve end
74. Underwire torsional loading movement
76. Underwire lateral loading movement
78. Prior art lengthwise axis of underwire
80. Flange 36 dimension parallel to longitudinal axis 58
82. Flange 36 dimension perpendicular to longitudinal axis 58
84. Aperture 44 dimension
86. Surrounding sidewall 26 width perpendicular to longitudinal axis 58
88. Aperture 44 dimension parallel to longitudinal axis 58
90. Aperture 44 dimension perpendicular to longitudinal axis 58
92. Overall height of flange 36 and surrounding sidewall 26
94. Overall height of flange 36
96. Interior width dimension perpendicular to longitudinal axis 58 and parallel to flange
36 planar surface 37
98. Interior height dimension perpendicular to longitudinal axis 58 and perpendicular to flange 36 planar surface 37
100. Radius at transition of 96 to 98, wherein the radius is one-half of 98
102. Interior depth dimension from opening 28 to base 24 along longitudinal axis 58
104. Bra wire thickness
106. Bra wire width
108. Interior volume of support device 20
110. Insertion of support structure 32

DETAILED DESCRIPTION

Figure 2:
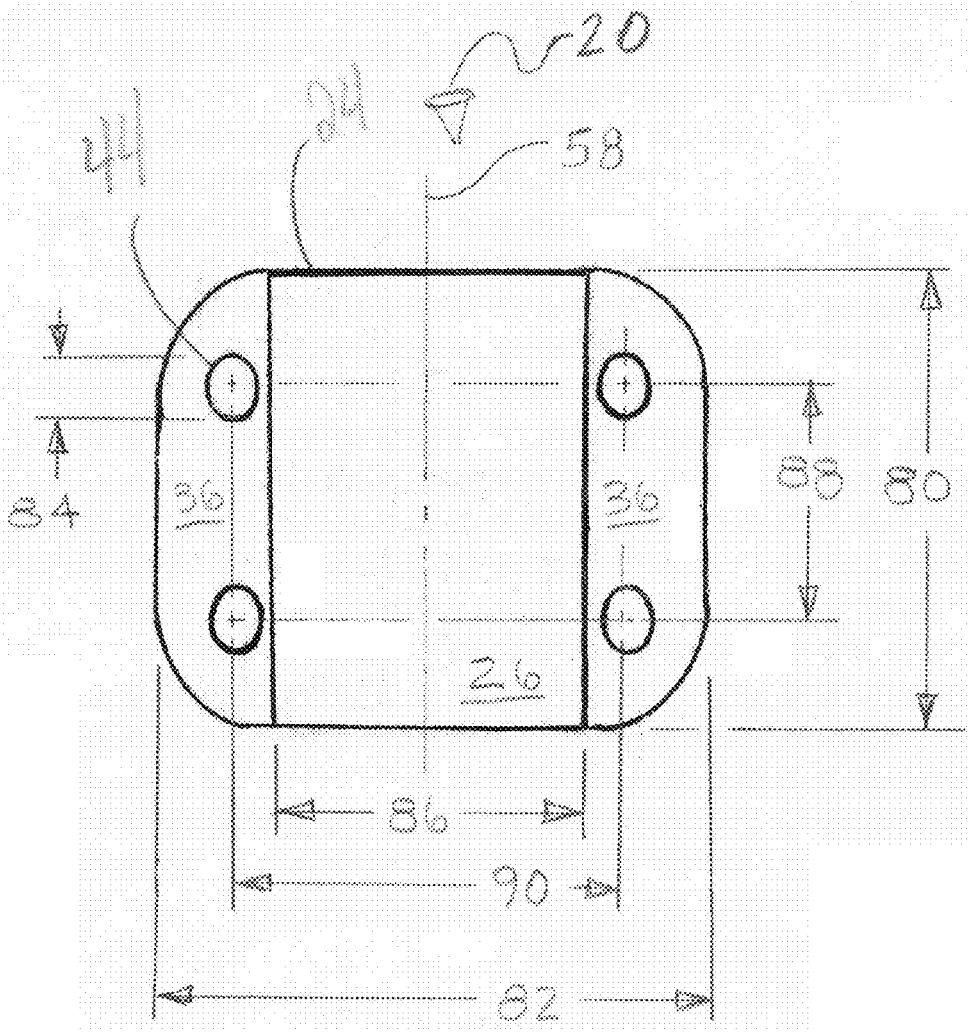
FIG. 2 shows a top view of the support device with the base, the sidewall extending from the base, and the flange with the plurality of apertures.

With initial reference to FIG. 1 shown a perspective view of a support device 20 with a base 24, a surrounding sidewall 26 extending from the base 24, and with the surrounding sidewall 26 terminating in an opening 28, wherein the base 24 and surrounding sidewall 26 define an interior 30, also shown is a flange 36 that is oppositely disposed of the interior 30, wherein the flange 36 has a plurality of apertures 44 shown. Continuing, FIG. 2 shows a top view of the support device 20 with the base 24, the sidewall 26 extending from the base 24, and the flange 36 with the plurality of apertures 44. Further FIG. 2 shows the flange dimension 80 that is parallel to the longitudinal axis 58, wherein the flange 36 dimension 80 is preferably about 0.35 inches, also the flange 36 dimension 82 perpendicular to longitudinal axis 58, wherein dimension 82 is preferably about 0.42 inches, further an aperture 44 dimension 84 that is preferably about 0.04 inches at its smallest dimension, for stitching 48 to be feed therethrough, wherein the shape of aperture 44 could be semi-circular, elliptical, and so on. Also in FIG. 2, shown is the surrounding sidewall 26 width 86 that is perpendicular to longitudinal axis 58, with the width preferably being about 0.23 inches, Next, on the positioning of the apertures 44, for the aperture 44 dimension 88 parallel to longitudinal axis 58, wherein dimension 88 is preferably about 0.16 inches, and for Aperture 44 dimension 90 perpendicular to longitudinal axis 58, wherein dimension 90 is preferably about 0.28 inches.

Figure 3:
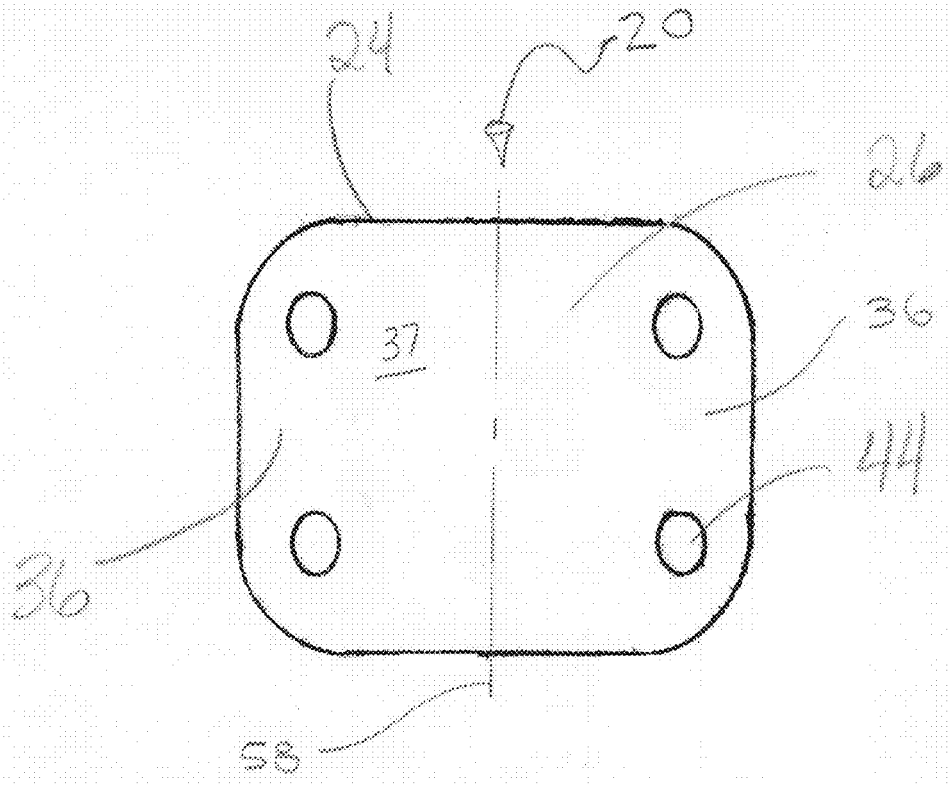
FIG. 3 shows a bottom view of the support device with the base and the flange having the plurality of apertures.
Figure 4:
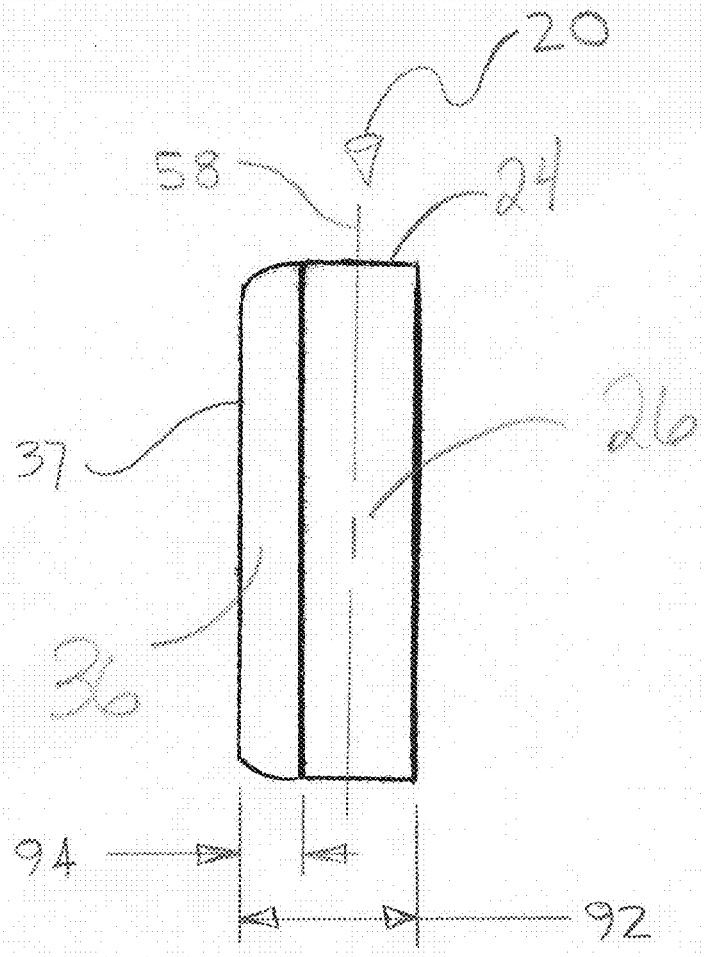
FIG. 4 shows a side view of the support device with the base, a portion of the sidewall, and the flange.

In addition FIG. 3 shows a bottom view of the support device 20 with the base 24 and the flange 36 having the plurality of apertures 44. Further, FIG. 4 shows a side view of the support device 20 with the base 24, a portion of the sidewall 26, and the flange 36. Also FIG. 4 shows the overall height dimension 92 of flange 36 and surrounding sidewall 26 combined, wherein dimension 92 is preferably about 0.14 inches, further, the overall height 94 of flange 36 is preferably about 0.06 inches.

Figure 5:
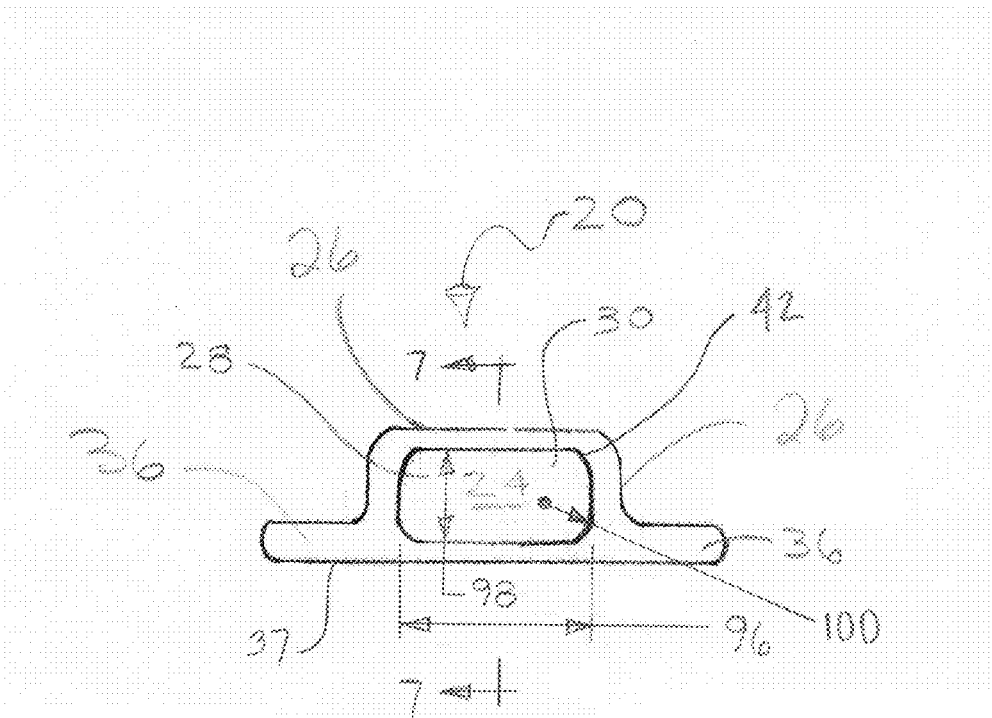
FIG. 5 shows a front view of the support device with the base, the sidewall, the opening, and the flange.

Continuing, FIG. 5 shows a front view of the support device 20 with the base 24, the sidewall 26, the opening 28, and the flange 36. Also, FIG. 5 shows the interior dimension 96 perpendicular to longitudinal axis 58 and parallel to flange 36, wherein 96 is preferably about 0.15 inches, further, the interior dimension 98 perpendicular to longitudinal axis 58 and perpendicular to flange 36, wherein dimension 98 is preferably about 0.08 inches, in addition, the radius 100 at transition of dimension 96 to dimension 98, wherein the radius is one-half of dimension 98 to have in effect a full or continuous radius or continuous curved surface 42 for the interior 30 as related to the surrounding sidewall 26.

Figure 6:
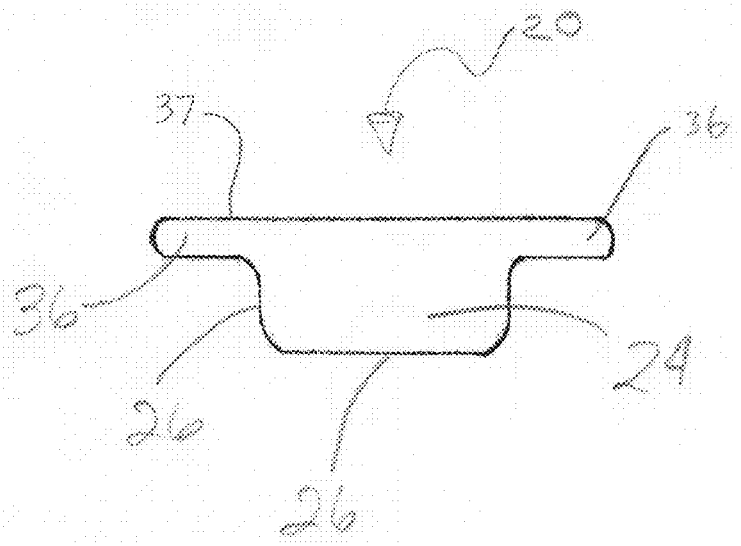
FIG. 6 shows a back view of the support device with the base, the sidewall, and the flange.
Figure 7:
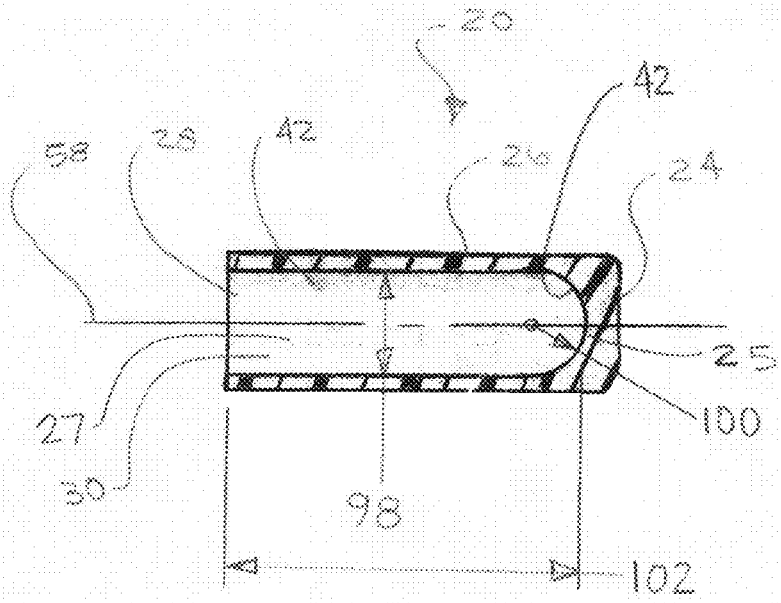
FIG. 7 shows cross section 7-7 from FIG. 5 of the support device showing the base, the sidewall extending from the base, with the sidewall being substantially about a longitudinal axis, wherein the base and sidewall define the interior that has a continuous curved surface and the flange.

Yet further, FIG. 6 shows a back view of the support device 20 with the base 24, the sidewall 26, and the flange 36 and FIG. 7 shows cross section 7-7 from FIG. 5 of the support device 20 showing the base 24, the sidewall 26 extending from the base 24, with the sidewall 26 being substantially about a longitudinal axis 58, wherein the base 24 and sidewall 26 define the interior 30 that has a continuous curved surface 42. Also, FIG. 7 shows dimension 98 in cross section as previously described in conjunction with radius 100 that is also present at the intersection of the surrounding sidewall 26 and the base 24, wherein as before the radius 100 is one-half of dimension 98 so that the interior 30 that has a continuous curved surface 42 at both the surrounding sidewall 26 itself, see FIG. 5, and the continuous curved surface 42 also at the surrounding sidewall 26 and base 24 surface 25 interface via radius 100, see FIG. 7, thus the continuous curved surface 42 exists throughout the entire interior 30. In addition, in FIG. 7 shown is the depth dimension 102 from opening 28 to base 24 along longitudinal axis 58, wherein dimension 102 is preferably about 0.24 inches.

Figure 8:
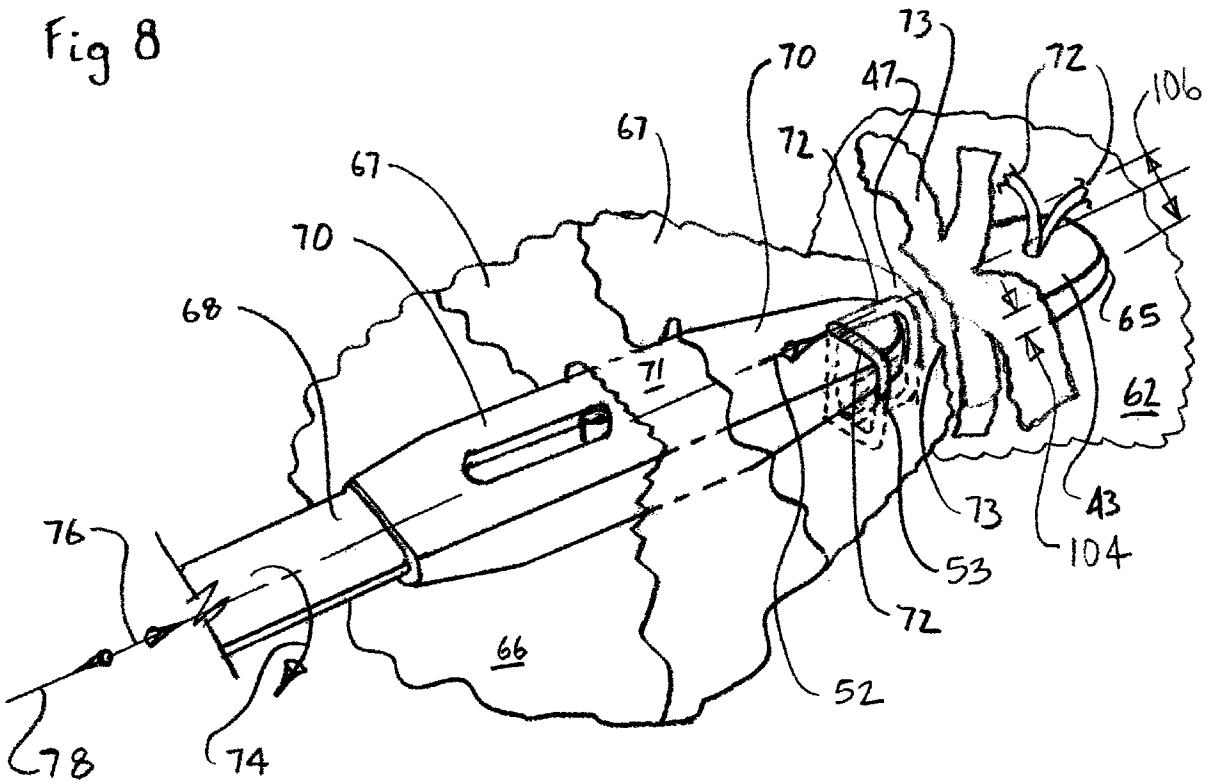
FIG. 8 shows a perspective view of a prior art bra underwire end portion tip protector that is secured to the bra fabric with stitching and a view of a protrusion or poking through of the bra underwire end portion tip through the bra fabric underwire casing.
Figure 9:
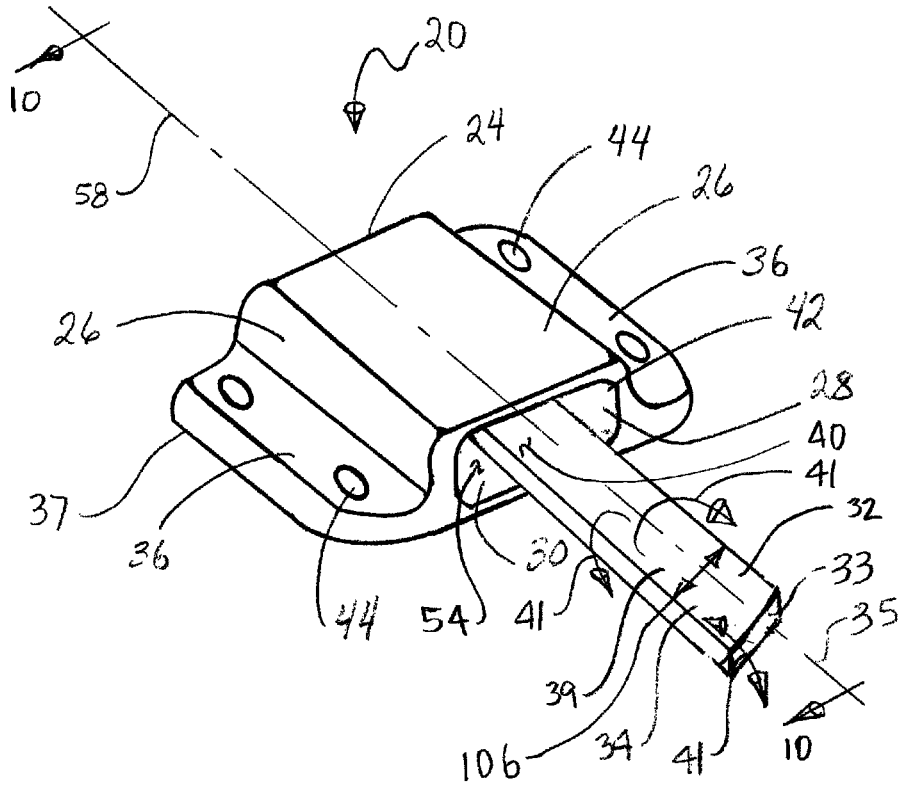
FIG. 9 shows a perspective use view of the support device with the base, the sidewall extending from the base, the flange with the plurality of apertures, with the interior and opening loosely receiving a bra underwire end portion, with the bra fabric removed for clarity.

Next, FIG. 8 shows a perspective view of a prior art bra 66 underwire end portion 68 tip protector 70 that is secured to the bra 66 fabric 67 with stitching 72 and a view of a protrusion 43 or poking through of the bra underwire end portion 68 tip 70 through the bra fabric 67 underwire casing 71. As shown in FIG. 8, the bra wire 39 tip 70 or protrusion 43 typically has a full radius as shown as across the width 106. Further continuing, FIG. 9 shows a perspective use view of the support device 20 with the base 24, the sidewall 26 extending from the base 24, the flange 36 with the plurality of apertures 44, with the interior 30 and opening 28 loosely receiving 54 a bra underwire end portion 40, with the bra fabric 38 removed for clarity. Also FIG. 9 shows the underwire 39 that typically has a width 106 of about 0.125 inches.

Figure 10:
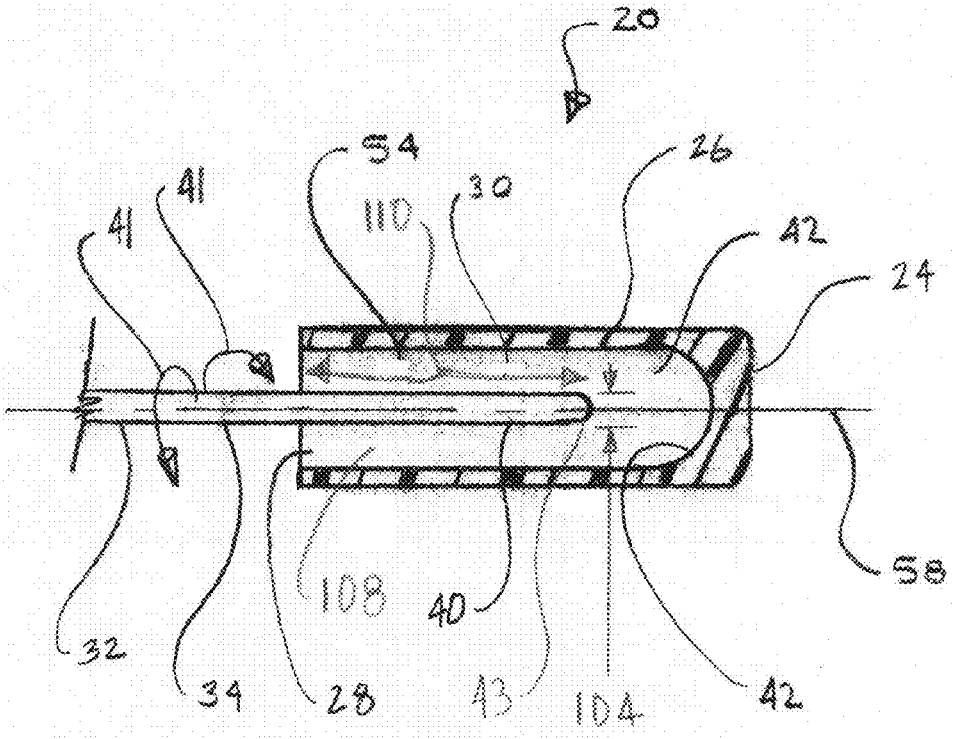
FIG. 10 shows cross section 10-10 from FIG. 9 for a use view of the support device with the base, the sidewall extending from the base, with the interior, and opening loosely receiving the bra underwire end portion, with the bra fabric removed for clarity.
Figure 11:
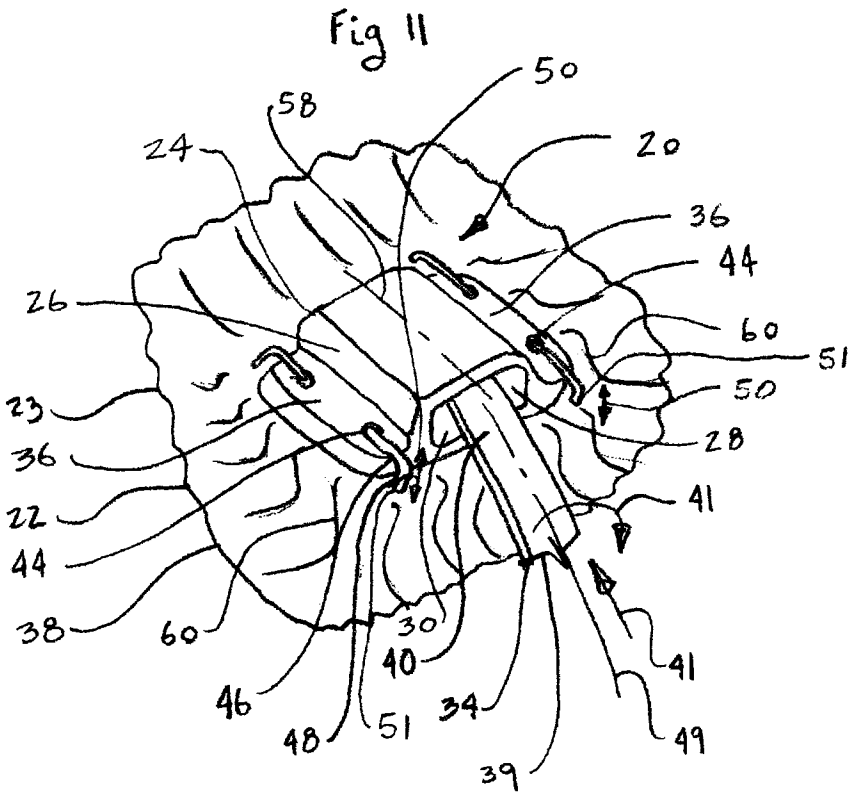
FIG. 11 shows a use view of the support device with the base, the sidewall extending from the base, and the flange with a plurality of apertures, with the interior and opening loosely receiving the bra underwire end portion that is applying an omnidirectional force, with the bra fabric in deflection, wherein the flange acting through the aperture in conjunction with an attachment to the fabric which is applying a substantially tensile force to the stitching and adjacent bra fabric.

Further continuing, FIG. 10 shows cross section 10-10 from FIG. 9 for a use view of the support device 20 with the base 24 and the sidewall 26 extending from the base 24, with the interior 30 and opening 28 loosely receiving 54 the bra underwire end portion 40, with the bra fabric 38 removed for clarity. Further, FIG. 10 shows the underwire 39 thickness 104 which is about 0.02 inches. Moving onward, FIG. 11 shows a use view of the support device 20 with the base 24, the sidewall 26 extending from the base 24, and the flange 36 with a plurality of apertures 44, with the interior 30 and opening 28 loosely receiving 54 the bra underwire end portion 40 that is applying an omnidirectional force 41, with the bra fabric in deflection 60, wherein the flange 36 acting through the aperture 44 in conjunction with an attachment element 46 to the fabric 38 is applying a substantially tensile force to the stitching 50 and adjacent bra fabric 51.

Further onward, FIG. 12 again shows cross section 10-10 from FIG. 9 for the use view of the support device 20 with the base 24, the sidewall 26 extending from the base 24, and the flange 36 with the apertures 44 in cross section, with the interior 30 and opening 28 loosely receiving 54 the bra underwire end portion 40 that is applying an omnidirectional force 41, with the addition of the bra fabric 38 in cross section minus the bra fabric underwire casing 45, wherein the flange 36 acting through the apertures 44 is applying a substantially tensile force to the stitching 50 and adjacent bra fabric 51.

Figure 13:
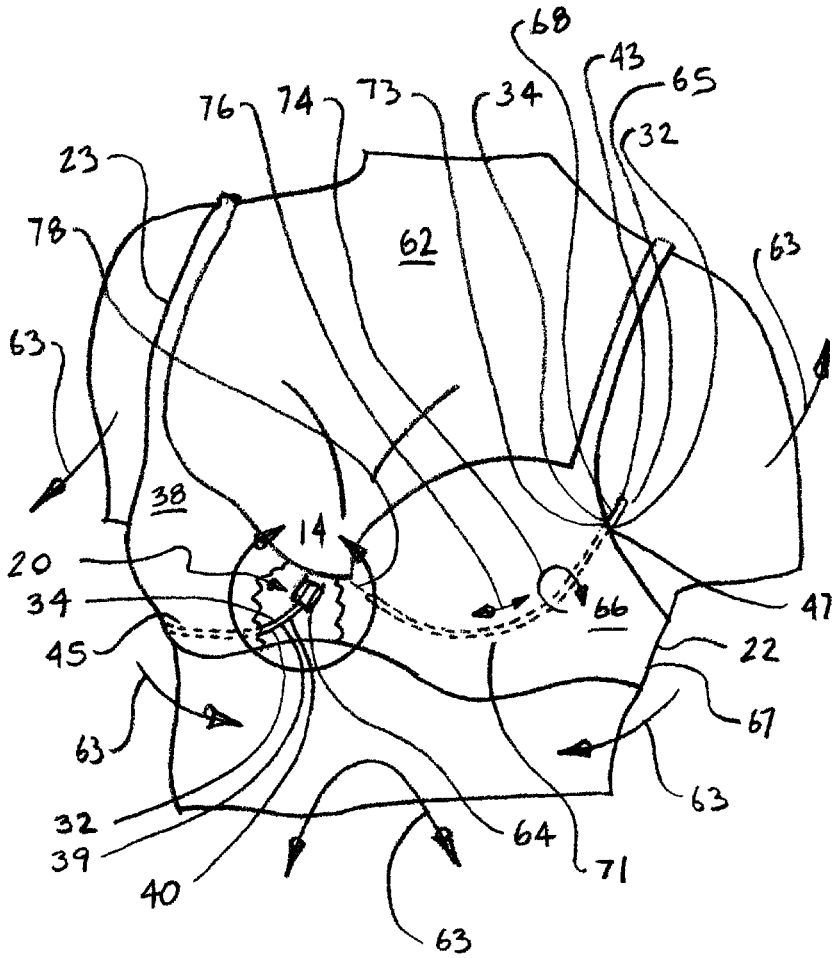
FIG. 13 shows a perspective use view of the support device as positioned in relation to the bra and the underwire end portion as typically worn by the user, in addition shown is a prior art underwire showing the undesirable protrusion or poke through of the underwire end portion.
Figure 14:
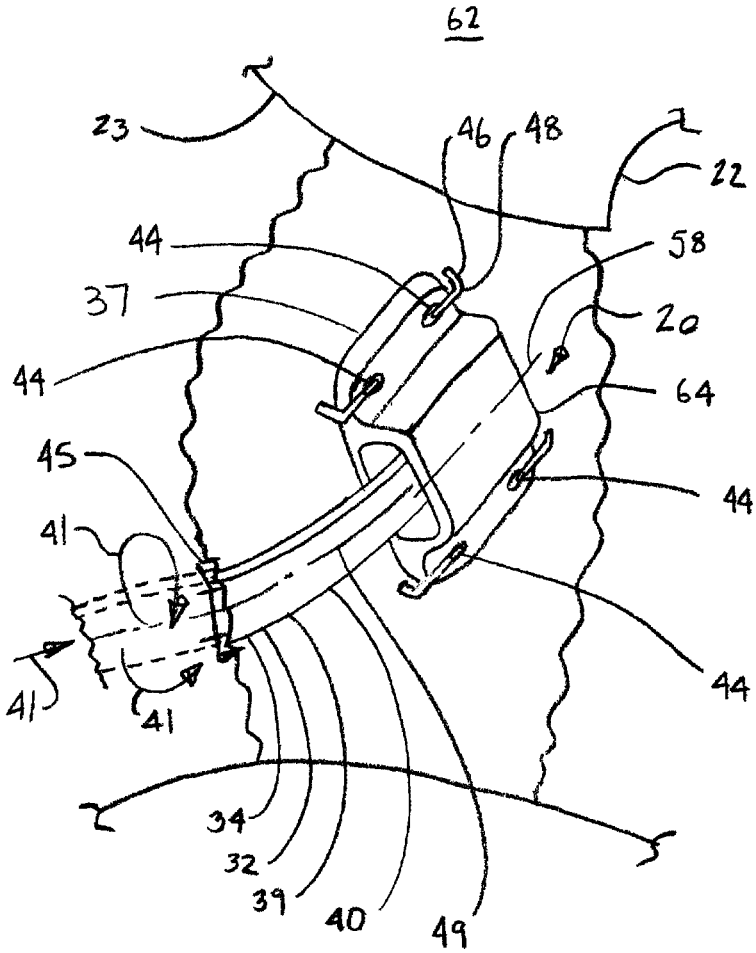
FIG. 14 shows an expanded perspective use view 14 from FIG. 13 of the support device as positioned in relation to the bra and the underwire end portion, including the attachment stitching to the bra fabric.

Next, FIG. 13 shows a perspective use view of the support device 20 as positioned in relation to the bra 23 and the underwire end portion 40 as typically worn by the user 62, in addition to showing the prior art bra 66 underwire end portion 68 protruding 43 from the prior art bra 66 fabric 67 casing 71, and FIG. 14 shows an expanded perspective use view 14 from FIG. 13 of the support device 20 as positioned in relation to the bra 23 and the underwire end portion 40, including the attachment stitching 48 to the bra fabric 38.

In referring to FIGS. 1 to 7, broadly the present invention of the article of clothing support device 20 for receiving a support structure 32 having a lengthwise axis 35 includes a base 24 and a surrounding sidewall 26 extending from the base 24 terminating in an opening 28. The sidewall 26 being about a longitudinal axis 58, wherein the base 24 and sidewall 26 define an interior 30, with the interior 30 including a sidewall surface 27 that is continuously curved 42 about the longitudinal axis 58. The interior 30 also including a base surface 25 that is perpendicularly oriented to the longitudinal axis 58 that is substantially continuously curved 42 as between the base 24 and the surrounding sidewall 26. The surrounding sidewall 26 also including an exterior surface 31 wherein a flange 36 extends therefrom, with the flange 36 forming a planar surface 37 opposite of the interior 30. The flange 36 planar surface 37 is adapted to attach to a fabric 38, see FIGS. 11, 12, and 14, the surrounding sidewall 26 interior 30 including a height dimension 98 that is perpendicular to the longitudinal axis 58 and perpendicular to the flange 36 planar surface 37 and a width dimension 96 that is perpendicular to the longitudinal axis 58 and parallel to the flange 36 planar surface 37, wherein the width dimension 96 is greater than the height dimension 98. Wherein a radius 100 that is one-half of the height dimension 98 is formed at an intersection of the height 98 and width 96 dimensions and the base 24 through the surface 25 to form the continuously curved surface 42, see FIGS. 5 and 7.

Continuing on the support device 20, the interior 30 also having a depth dimension 102 extending from the base 24 to the opening 28, see FIG. 7. Wherein the depth dimension 102 is greater than the width dimension 96, wherein the interior 30 receives a portion 110 of the support structure 32 associated 34 with an article of clothing, wherein the support structure 32 is not attached to the interior 30, see FIG. 10. Wherein the support structure 32 is allowed omnidirectional movement 41 in relation to the interior 30, with more movement of the support structure 32 relatively parallel to the flange 36 planar surface 37 as in use more movement of the support structure 32 necessitates the width 96 being greater that the height 98, due to the user's 62 moving the support structure 32 more in the width 96 direction from breathing and lateral arm movement, wherein the omnidirectional movement 41 includes bi-directional movement lengthwise along the longitudinal axis 58 or lengthwise axis 35, such that operationally the support structure 32 is able to have bi-directional movement along the longitudinal axis 58 or lengthwise axis 35 without translating the bi-directional movement into any movement of the support device 20 due to the support structure 32 not being attached to the interior 30. Wherein the radius 100 further prevents attachment of the support structure 32 or bra underwire 39 to the interior 30 via providing the continuously curved surface 42 that doesn't "grab" the support structure 32.

Further, of the article of clothing support device 20 for receiving a support structure 32 the opening 28 preferably has an opening area 29 that is at least four (4) times a cross sectional area 33 of the support structure 32, wherein the cross sectional area 33 of the support structure 32 is defined as being in a plane that is perpendicular to the lengthwise axis 35, see FIG. 9. Continuing, on the article of clothing support device 20 for receiving a support structure 32 wherein the interior 30 has an interior volume 108 defined by the height dimension 98 multiplied by the width dimension 96 multiplied by the depth dimension 102, see FIGS. 5 and 7, wherein the support structure 32 has an insertion 110 volume defined by the support structure 32 cross sectional area 33 multiplied by the depth dimension 102 such that the interior 30 volume 108 is preferably at least four (4) times the support structure 32 insertion 110 volume, thus as long as the opening area 29 that is at least four (4) times the cross sectional area 33, the depth 102 can be increased.

Continuing, on the article of clothing support device 20 for receiving a support structure 32, the width dimension is preferably at least one and seven-eighths (1⅞) times the height dimension 98. Further, on the article of clothing support device 20 for receiving a support structure 32 the depth dimension 102 is at least one and six-tenths (1.6) times the width 96 dimension, again see FIGS. 5 and 7.

Broadly the present invention of the article of clothing 22 support device 20, includes the base 24, the surrounding sidewall 26 extending from the base 24, with the sidewall 26 terminating in the opening 28, wherein the base 24 and the sidewall 26 define an interior 30, as best shown in FIGS. 1 through 7. Wherein the interior 30 is sized and configured to loosely receive 54 a portion of a support structure 34 associated with the article of clothing 22 as best shown in FIGS. 9 through 14. Also included in the support device 20 is the flange 36 that extends from the sidewall 26, with the flange 36 being positioned to be oppositely disposed of the interior 30 as best shown in FIGS. 1, 5, 9, 11, and 14, wherein the flange 36 is adapted to attach to the fabric 38 as best shown in FIGS. 11 through 14. As far as the materials of construction for the support device 20, the functional requirements would include a water proof material for a garment or article of clothing 22 as in the case of a bra 23 to sustain multiple clothing washing and drying cycles in addition to handling corrosion caused by perspiration from the user 62, plus the material should have a fair degree of strength to be made in somewhat of a small size so as to not be obtrusive to the bra 23 user 62 either in "feel" or in appearance, as in an ideal sense the support device 20 should be almost invisible to user's 62 feel and appearance.

Thus, the materials of construction for the support device 20 could include polyethylene, polypropylene and polyurethane type materials, however, the materials would not be limited to the aforementioned plastics as any suitable alternative for both manufacturing and use of the support device 20 would be acceptable including but not limited to materials selected from the group consisting essentially of stainless steels or any other material that would meet the aforementioned functional requirements. Alternatively, the materials of construction for the support device 20 may also include a transparent or semi transparent material for aesthetic purposes or in a selected color either to appear nearly invisible or to substantially match the color or hue of the fabric 38 of the garment or article of clothing 22 that the support device 20 is adapted to be attached to.

More particularly, the interior 30 is sized and configured to loosely receive 54 the support structure 32 in the form of a bra 23 underwire end portion 40 that can move in a limited omnidirectional manner 41 in relation to the interior 30, as best shown in FIGS. 9 through 14. Thus, in the case of a bra 23, this relatively rigid support structure is typically constructed of a flat steel strip that is configured in somewhat of a "U" or semi circular type shape which is typically called the bra underwire 39. The underwire 39 forms a semicircular base for the lower half of each breast cup of the bra 23, wherein the underwire 39 is positioned at the interface between the user's 62 torso and each their breasts, see FIG. 13. The underwire 39 is disposed within the bra 23 fabric 38 casing 45 to create omnidirectional support rigidity for each breast cup of the bra, wherein the bra 23 is necessarily made from a soft and sometimes shear (see through) fabric 38 for user 62 comfort adjacent to their skin and for appearance reasons, see FIGS. 13 and 14.

This underwire 39 end portion 40 protrusion 43 from the bra 23 fabric 38 underwire 39 casing 45 can be caused from a number of factors that include bra 23 user 62 upper torso and arm movement, in addition to forces to the bra 23 that are external to the bra 23 user 62 such as an assault by a 3$^{rd}$ party upon the user 62 and the like, and bra 23 fabric 38 deterioration from washing, drying, and aging, see FIGS. 8 and 13. When the bra 23 underwire 39 end portion 40 does protrude 43 or "poke through" the bra 23 fabric 38 underwire 39 casing 45 (or casing 71 in the prior art bra 66 fabric 67), this results in damage to the bra 23 fabric 38 underwire 39 casing 45 (normally resulting in the bra 23 having to be replaced) and possible injury to the bra 23 user 62 from the protruding 43 underwire 39 end portion 40 chaffing or piercing the bra user's 62 skin adjacent to the bra 23 fabric 38 underwire 39 casing 45/underwire 39 end portion 40 interface 47, see FIGS. 8 and 13. Thus the support device 20 helps to retain the underwire 39 end portion 40 in the bra 23 fabric 38 casing 45 thus assisting in the prevention of the underwire 39 end portion 40 poking 43 through the bra 23 fabric 38 casing 45, again see FIGS. 8 and 13.

Physical activities such as running, tennis, bicycling, wrestling, swimming, and the like by the user 62 of the bra 23 can all contribute to the underwire 39 end portion 40 poking 43 through the bra 23 fabric 38 underwire 39 casing 45. In addition, because most bras 23 have two separate underwires 39 that are non symmetrically shaped and fairly rigid i.e. the "U" shape, see FIG. 13, wherein when the underwire 39 experiences a force from the user's 62 movement 63, it typically causes the underwire 39 to experience both a torsional (twisting) loading 74 (movement) and a combined lateral (lengthwise) loading 76 (movement) as shown for the prior art bra 66 in FIG. 13. Or the torsional movement 74 and lateral movement 76 resulting in a combined underwire end portion 40 omnidirectional movement 41 as shown with the support device 20 in FIG. 14. Thus the underwire 39 end portion 40 will exert both protruding 43 force against the bra 23 underwire 39 casing 45 fabric 38 that is transverse to the underwire 39 lengthwise axis 49 and a force parallel to the underwire 39 lengthwise axis 49, intensifying (due to the combined forces) the potential for poke through 43 damage from the underwire 39 end portion 40 through the bra 23 underwire 39 casing 45. Resulting in what leads to the omnidirectional movement 41 (from the combined forces) of the bra 23 underwire 39 end portion 40 as against the bra 23 fabric 38 casing 45. This is as opposed to a symmetric garment stiffener, i.e. straight not being "U" shaped, wherein a force at one end (from user movement) will typically result in a single force at the other end of the stiffener that is parallel to the stiffener lengthwise axis.

Thus the support device 20 that can secure the bra 23 underwire 39 end portion 40 to the bra 23 fabric 38 casing sleeve 45 by having a type of "soft" restraint that can accommodate user 62 torso and arm movement without adding much bulk to the bra 23 fabric 38 casing sleeve 45 adjacent to the underwire 39 end portion 40 such that the user 62 is practically unaware of the support device 20 is installed in the bra 23. The key to the soft restraint is in allowing some degree of limited omnidirectional movement 41 of the underwire 39 end portion 40 within the bra 23 fabric 38 casing sleeve 45 to cushion the restraint (to help prevent protrusion 43, see FIGS. 8 and 13) so as to reduce the bearing load that the underwire 39 end portion 40 would normally have against the bra 23 fabric 38 casing sleeve 45, specifically being the casing sleeve end 73. Looking specifically at FIG. 8, a typical prior art solution to the aforementioned protrusion 43 or poke through problem was to have a slidable engagement of the tip 70 to the underwire end portion 68, allowing some amount of movement 76 along the underwire lengthwise axis 49, then once the slidable engagement bottoms out, the tip 70 will put the stitching 72 into shear 52 and the adjacent fabric 67 into shear 53. Wherein shear stress is the weakest strength of material for the stitching 72 and adjacent fabric potentially leading to failure of the stitching 72 and then the undesirable protrusion 43 of the tip 70 through the bra 66 fabric 67 casing sleeve end 73 with the aforementioned associated problems. The aforementioned concept can be seen in the use of a typical button on a shirt attached by sewing thread, or in the case of a pants or shorts waist button, wherein when a force is applied tending to "pull apart" either the shirt button joint or pant/shorts waist button attachment the, fabric surrounding the button deflects to in effect "stress relieve" the button attachment resulting in a substantially tension force on the button thread and adjacent shirt/pants/shorts fabric resulting in the button attachment having higher strength as opposed if the fabric were substantially rigid, didn't deflect and put the button attachment thread in shear, resulting in an easier failure of the button thread.

Figure 12:
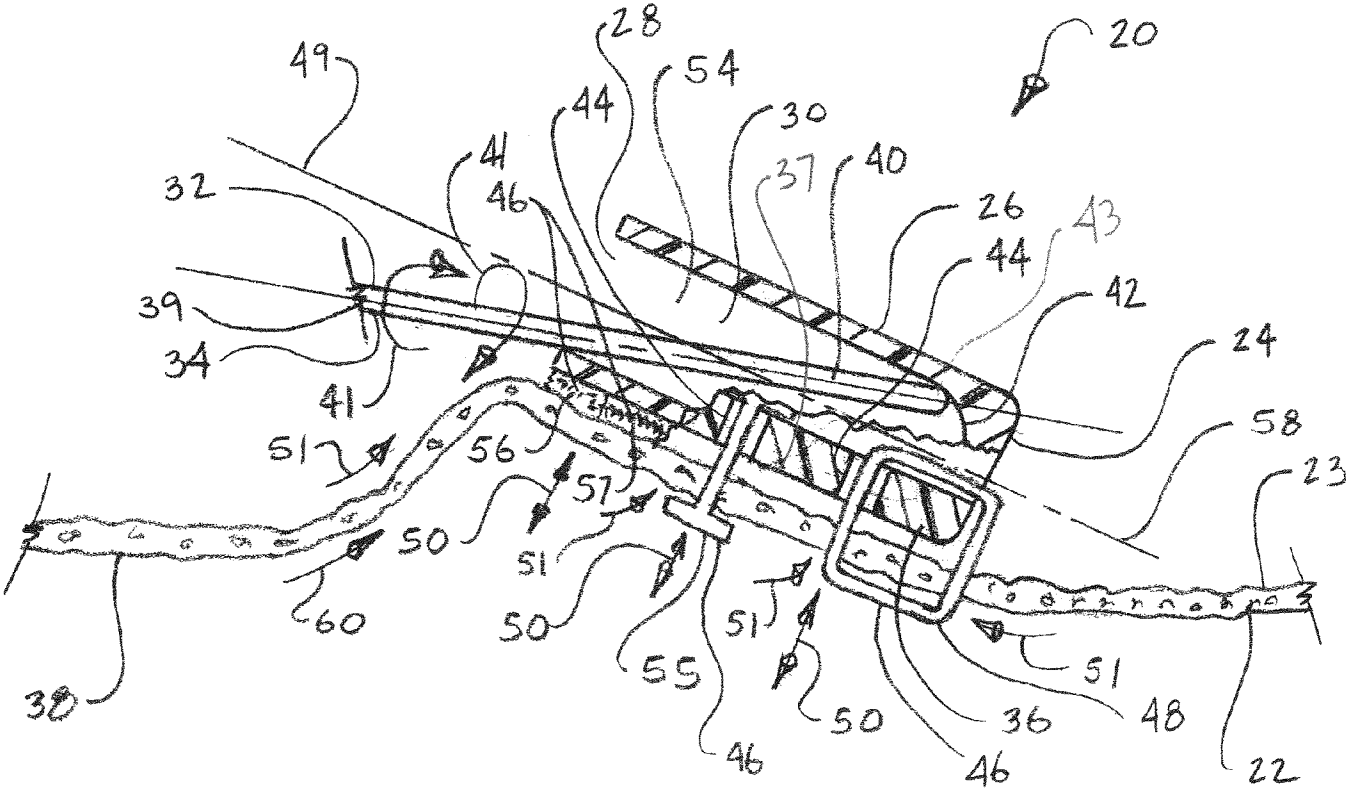
FIG. 12 again shows cross section 10-10 from FIG. 9 for the use view of the support device with the base, the sidewall extending from the base, and the flange with the apertures in cross section, with the interior and opening loosely receiving the bra underwire end portion that is applying an omnidirectional force, with the addition of the bra fabric in cross section minus the bra fabric casing, wherein the flange acting through the apertures is applying a substantially tensile force to the stitching and adjacent bra fabric.

Thus, in referring particularly to FIGS. 11 and 12, the support device 20 has the soft restraint of the underwire end portion 40 that would allow for omnidirectional movement 41 between the underwire end portion 40 and the support device 20 in the form of a couple. This couple could facilitate the support device 20 attachment 46 to the bra 23 fabric 38 being movable such that the attachment stitching 48 when restraining the underwire 39 end portion 40 could be substantially put into tension 50 as well as the adjacent fabric 38 into tension 51 as opposed to putting the attachment stitching 48 into shear 52 along with the adjoining bra fabric 38 into shear 52. As most materials have approximately twice the strength in tension as opposed to shear this would act to considerably increase the strength of the support device 20 attachment to the bra 23 fabric 38 thus helping to further preclude the undesirable protrusion 43 of the underwire end portion 40 through the bra 23 fabric 38 with the attendant previously discussed problems. In order to help facilitate the omnidirectional movement 41 of the underwire 39 end portion 40, the support device 20 has an optional interior 30 with a substantially continuous curved surface 42 as between the base 24 and the surrounding sidewall 26 and the sidewall 26 about the support device 20 longitudinal axis 58 as best seen in FIGS. 1, 5, and 7. Thus, the support device 20 flange 36 is positioned in relation to the sidewall 26 such that the interior 30 loosely receiving the support structure 32 which can be in the form of a bra 23 underwire end portion 40 is operational to automatically position the flange 36 in relation to the fabric 38 such that the flange 36 attachment to the fabric 38 which can be in the form of the attaching element 46 is substantially in tension 50 due to the relative movement of the support structure 32 to the interior 30 as best shown in FIGS. 11 and 12.

The support device 20 flange 36 is optionally sized and configured to include an aperture 44 therethrough, with the aperture 44 being operational to allow an attaching element 46 to substantially secure the flange 36 to the fabric 38. Also optionally, there can be a plurality of apertures 44 in the flange 36 utilized to allow a plurality of attaching elements 46 to the fabric. The shape of the aperture 44 could be circular, square, rectangular, elliptical, semicircular, triangular, and the like, however, the shape of the aperture 44 would not be limited to the aforementioned shapes as any suitable alternative shape for both manufacturing of the aperture 44 and use of the attaching element 46 would be acceptable. Preferably, the attaching element 46 is constructed of materials selected from the group consisting essentially of attachment stitching 48 and fasteners 55 that can utilize the aperture 44 as best shown in FIG. 12. However, as the aperture 44 is optional, another way to adapt the flange 36 to attach to the fabric 38 without the need of the aperture 44 is constructed of attachment materials selected from the group consisting essentially of adhesive 56 and hook and loop 57 fasteners, also as best shown in FIG. 12. Note that any of the aforementioned attaching elements 46, including stitching 48, fasteners 55, adhesive 56, hook and loop 57 fasteners, or any alternative attaching element 46 need to meet the previously mentioned functional requirements of restraining the underwire 39 end portion 40 with the attaching element 46 to be substantially put into tension 50, in addition to multiple washing and drying cycles, and handling corrosion caused by perspiration from the user 62.

The main point to make is that the present invention 20 is that it is designed to primarily repair an existing bra 23 with a bra wire 39 poke through 43 failure, wherein with the addition of device 20 to the failed bra 23 via stitching 46, 48, will restore and retain the bra wire 39 to its original position of when the bra 23 was new, thus extending the life of the bra 23. That being said, the device 20 has absolutely no attachment to the bra wire 39 itself, as the device 20 loosely receives 54 the structure 32 or bra wire 39 for the purpose of retaining the bra wire 39 close to its original position when the bra 23 was new. Wherein the diffusing of bra wire 39 loading 41, as shown in FIG. 12, is spread out over the aperture 44 stitching 48 using preferably four aperture 44/stitching 48 loading points, as opposed the a conventional bra 23, as shown in FIG. 8 that typically has a single stitch 72 retaining the under wire 39 end portion 43 to the bra 23 being much more prone to failure from loading 74 and 76. Further, as an option the device 20 could be provided with the support structure 32 or the bra underwire 39 as a repair kit for the article of clothing 22.

Method of Use

Referring in particular to FIGS. 9 through 14, a method is disclosed for installing to use the support device 20 to receive a support structure 32 associated with an article of clothing 22 or garment, that includes the steps of firstly, providing a support device 20 that includes a base 24, a surrounding sidewall 26 extending from the base 24 terminating in an opening 28. Wherein the base 24 and sidewall 26 define an interior 30, with the interior 30 being sized and configured to loosely receive 54 a portion of the support structure 32 associated with the article of clothing 22. The support device 20 also including a flange 36 extending from the sidewall 26, with the flange 36 being positioned to be oppositely disposed of the interior 30, wherein the flange 36 is adapted to attach to a fabric 38. Next, a step of grasping the support device 20 to be adjacent to the article of clothing 22 and to be adjacent to the portion of the support structure 32 associated with the article of clothing 22 and a further step of positioning the support device 20 such that the portion of the support structure 20 associated with the article of clothing 22 is disposed within the interior 30 creating a selected position 64 of the support device 20 adjacent to the article of clothing 22. A further step is of attaching the flange 36 to the article of clothing 22 at the selected position 64.

Optionally, the aforementioned attaching step can utilize an aperture 44 in the flange 36 for using an attaching element 46 that is operational to attach the flange 36 to the article of clothing 22. Further, an optional step can be added of confirming that the interior 30 is loosely receiving 54 the support structure 32 associated with the article of clothing 22 that is operational to automatically position the flange 36 in relation to the fabric 38 such that the attaching element 46 is substantially in tension 50 due to relative movement of the support structure 32 to the interior 30.

Conclusion

Accordingly, the present invention of a support device has been described with particularity directed at the embodiments of the present invention. The present invention is defined by the following claims construed in light of prior art so modifications or changes may be made to the exemplary embodiments of the present invention without departing from the inventive concepts contained therein.

The invention claimed is:

1. An article of clothing support device for receiving a support structure having a lengthwise axis, comprising:

(a) a base; and (b) a surrounding sidewall extending from said base terminating in an opening, said sidewall being about a longitudinal axis, wherein said base and sidewall define an interior, said interior including a sidewall surface that is continuously curved about said longitudinal axis, said interior also including a base surface that is perpendicularly oriented to said longitudinal axis that is substantially continuously curved as between said base and said surrounding sidewall, said surrounding sidewall also including an exterior surface wherein a flange extends therefrom, with said flange forming a planar surface opposite of said interior, said flange planar surface is adapted to attach to a fabric, said surrounding sidewall interior including a height dimension that is perpendicular to said longitudinal axis and perpendicular to said flange planar surface and a width dimension that is perpendicular to said longitudinal axis and parallel to said flange planar surface, wherein said width dimension is greater than said height dimension, wherein a radius that is one-half of said height dimension is formed at an intersection of said height and width dimensions and said base to form said continuously curved surface, said interior also having a depth dimension extending from said base to said opening, wherein said depth dimension is greater than said width dimension, wherein said interior receives a portion of the support structure associated with an article of clothing, wherein the support structure is not attached to said interior, wherein the support structure is allowed omnidirectional movement in relation to said interior, with more movement of the support structure relatively parallel to said flange planar surface, wherein said omnidirectional movement includes bi-directional movement lengthwise along said longitudinal axis, such that operationally the support structure is able to have bi-directional movement along said longitudinal axis without translating the bi-directional movement into any movement of said support device.

2. An article of clothing support device for receiving a support structure according to claim 1, wherein said opening has an opening area that is at least four (4) times a cross sectional area of the support structure, wherein the cross sectional area of the support structure is defined as being in a plane that is perpendicular to the lengthwise axis.

3. An article of clothing support device for receiving a support structure according to claim 2 wherein said interior has an interior volume defined by said height dimension multiplied by said width dimension multiplied by said depth dimension, wherein the support structure has an insertion volume defined by said support structure cross sectional area multiplied by said depth dimension such that said interior volume is at least four (4) times the support structure insertion volume.

4. An article of clothing support device for receiving a support structure, according to claim 3 wherein said width dimension is at least one and seven-eighths (1⅞) times said height dimension.

5. An article of clothing support device for receiving a support structure according to claim 4 wherein said depth dimension is at least one and six-tenths (1.6) times said width dimension.

6. An article of clothing support device for receiving a support structure according to claim 5, wherein said flange is sized and configured to include an aperture therethrough, further including an attaching element partially disposed within said aperture, said aperture and said attaching element being operational to substantially attach said flange to the fabric.

7. An article of clothing support device for receiving a support structure according to claim 6, wherein said attaching element is made of materials selected from the group consisting essentially of attachment stitching and fasteners.

8. An article of clothing support device for receiving a support structure according to claim 7, wherein said flange is positioned in relation to said sidewall such that the omnidirectional movement of the support structure in relation to said interior is operational to automatically position said flange planar surface in relation to the fabric such that said flange attachment to the fabric is substantially in tension.

9. An article of clothing support device for receiving a support structure according to claim 1, wherein said base, surrounding sidewall, and flange are made of materials selected from the group consisting essentially of polyethylene, polypropylene and polyurethane materials.

10. An article of clothing support device for receiving a support structure according to claim 1, wherein said base, surrounding sidewall, and flange are made of materials selected from the group consisting essentially of stainless steels.

11. An article of clothing support device for receiving a support structure according to claim 1, wherein said base, surrounding sidewall, and flange are substantially transparent.

12. An article of clothing support device, comprising:

(a) a support structure having a lengthwise axis, said support structure in the form of a bra underwire including a thickness and a width, with said width greater than said thickness, said thickness and said width forming a rectangular cross section area, wherein said rectangular cross section area is defined as being in a plane that is perpendicular to said lengthwise axis;

(b) a base; and (c) a surrounding sidewall extending from said base terminating in an opening, said sidewall being about a longitudinal axis, wherein said base and sidewall define an interior, said interior including a sidewall surface that is continuously curved about said longitudinal axis, said interior also including a base surface that is perpendicularly oriented to said longitudinal axis that is substantially continuously curved as between said base and said surrounding sidewall, said surrounding sidewall also including an exterior surface wherein a flange extends therefrom, with said flange forming a planar surface opposite of said interior, said flange planar surface is adapted to attach to a fabric, said surrounding sidewall interior including a height dimension that is perpendicular to said longitudinal axis and perpendicular to said flange planar surface and a width dimension that is perpendicular to said longitudinal axis and parallel to said flange planar surface, wherein said width dimension is greater than said height dimension, wherein said height dimension multiplied by said width dimension define an area of said opening, wherein said opening area is at least four (4) times said rectangular cross section area of said support structure, wherein a radius that is one-half of said height dimension is formed at an intersection of said height and width dimensions and said base to form said continuously curved surface, said interior also having a depth dimension extending from said base to said opening, wherein said depth dimension is greater than said width dimension, wherein said interior receives a portion of said support structure associated with an article of clothing, wherein said support structure is not attached to said interior, wherein said support structure is allowed omnidirectional movement in relation to said interior, with more movement of said support structure relatively parallel to said flange planar surface, wherein said omnidirectional movement includes bi-directional movement lengthwise along said longitudinal and lengthwise axes, such that operationally said support structure is able to have bi-directional movement along said lengthwise axis without translating said bi-directional movement into any movement of said support device, wherein said radius further prevents attachment of said support structure to said interior.

13. An article of clothing support device according to claim 12 wherein said interior has an interior volume defined by said height dimension multiplied by said width dimension multiplied by said depth dimension, wherein said support structure has an insertion volume defined by said support structure rectangular cross sectional area multiplied by said depth dimension such that said interior volume is at least four (4) times said support structure insertion volume.

14. An article of clothing support device according to claim 13 wherein said width dimension is at least one and seven-eighths (1⅞) times said height dimension.

15. An article of clothing support device according to claim 14 wherein said depth dimension is at least one and six-tenths (1.6) times said width dimension.

* * * * *